US005534060A

United States Patent [19]

Johnson

[11] Patent Number: 5,534,060

[45] Date of Patent: Jul. 9, 1996

[54] SPIN CUP AND SPIN CUP DRIVE FOR APPLYING VISCOUS MATERIALS

[75] Inventor: Raymond C. Johnson, Oxford, Mich.

[73] Assignee: Schenck Turner Inc., Orion, Mich.

[21] Appl. No.: 345,580

[22] Filed: Nov. 28, 1994

[51] Int. Cl.[6] ..... B05C 5/00

[52] U.S. Cl. ..... 118/55; 118/317; 118/323; 239/222.11; 239/222.13

[58] Field of Search ..... 118/52, 54, 55, 118/317, 323, 683, 712; 239/214, 215, 216, 217, 222.11, 222.13, 223

[56] References Cited

U.S. PATENT DOCUMENTS

| | | | |
|---|---|---|---|
| 3,029,027 | 4/1962 | Gray | 118/55 |
| 3,204,604 | 9/1965 | Barich et al. | 118/317 |
| 3,782,636 | 1/1974 | Donnelly | 118/317 |
| 4,414,918 | 11/1983 | Nelson Holland et al. | 118/317 |
| 5,225,239 | 7/1993 | Ostin | 118/712 |

FOREIGN PATENT DOCUMENTS

| | | | |
|---|---|---|---|
| 0463742 | 1/1992 | European Pat. Off. | 239/222.11 |

*Primary Examiner*—Laura Edwards

*Attorney, Agent, or Firm*—Reising, Ethington, Barnard & Perry

[57] ABSTRACT

Machine and method for applying an anaerobic sealant and locking material into a workpiece bore in which an outwardly flaring cup mounted onto a rotatable anaerobic material reservoir and spin cup drive having a truncated conical wall with openings therein to feed the anaerobic material into the flaring spin cup in response to the centrifugals on the material as the reservoir and spin cup is rotatably driven. The anaerobic material will be spun from the cup in a controlled manner so that an annular layer of anaerobic material is applied onto the bore wall. A closure member can be subsequently inserted into the bore being sealed and permanently retained therein by the material. In a preferred method, the reservoir and spin cup assembly is moved between a retracted material load position and an extended material apply position.

16 Claims, 4 Drawing Sheets

28
48
42
44
34
58
46
50
20
96
30
82
88
86
54
22
126
88
52
84
101
98
76
24
96
104
100
38
62
60
99
64
40
102
92
70
143
143
170
108
140
126
118
10
26
16
12
5

SPIN CUP AND SPIN CUP DRIVE FOR APPLYING VISCOUS MATERIALS

FIELD OF THE INVENTION

This invention relates to machines for distributing viscous materials to work surfaces and, more particularly, to a spin cup and spin cup drive unit and providing an assembly for applying anaerobic materials onto the wall defining a bore in a component for retaining and sealing a closure or other member subsequently installed in the bore.

DESCRIPTION OF RELATED ART

Prior to the present invention, various machines and methods have been provided to control and apply sealants and locking material in confined spaced included threaded and unthreaded bores and cavities so that components such as threaded fasteners or plugs can be installed and positively retained therein after curing. For example, formulations such as LOCKTITE® 222, 242, 243, 271, 272, 290, 565, 500, anaerobic sealing and locking or sealing materials which cure in the absence of air manufactured by the LOCKTITE CORPORATION, Automotive and Consumer Group, Cleveland, Ohio, 44128, has been applied with special equipment into threaded and unthreaded openings to retain and/or seal a closure therein. Some of such material may be suitable for use in engine freeze plug bores so that a freeze plug can be subsequently installed therein with high strength retention by the anaerobic material which is effective over wide temperature range, (minus 65° degrees to 400° F., for example).

While the prior application devices and methods have provided for good sealing and retention, difficulties have been encountered with the handling and delivery of the anaerobic materials into the bores to be closed. In some instances, the material becomes inadvertently spilled or disbursed on the application devices, work areas, and onto the work itself. Clean-up of such components and work areas is time consuming and laborious. Downtime required for such clean-up including refurbishment of the applicator adds to the labor cost and ultimately to the cost of the components being sealed or sealed and permanently closed by the closure member.

In contrast to the prior dispensing methods, machines and mechanisms, the present invention is drawn to a new improved mechanism, machine and method for receiving anaerobic sealing and locking material or other highly viscous material from a source spaced from the work. After receiving the material, the machine can be turned or tilted to an apply position in which an interior reservoir cup holding the anaerobic material and an outwardly flared spin cup secured to the reservoir cup are within an opening in a component to be closed. On rotational drive of the reservoir and spin cup assembly, the material is displaced through small openings in the reservoir cup onto the inner wall of the spin cup where the material is spun in a controlled manner from the outer edges of the spin cup onto the inner wall of the opening of the work. After apply of an annular ribbon of the material onto the walls of the opening, the spin cup and reservoir assembly is withdrawn from the opening and a protective shroud is moved to cover the spin cup so that material spillage from the tooling will be confined by the shroud. A blocker member is subsequently inserted into the opening where the anaerobic material in absence of air cures and permanently seals or secures and seals the blocker member in place.

It is a feature, object and advantage of this invention to provide a new and improved mechanism and method for supplying an anaerobic material into the outer end of a spin and reservoir cup assembly and moving this assembly from a supply position into a work position while the material is in the reservoir cup and then spinning the assembly within a cavity or bore to apply a coating or ribbon of the anaerobic material onto the wall of said cavity or bore for the subsequent rigid securement of a closure to the wall of the cavity or bore.

Another feature, object and advantage of this invention is to provide a new and improved mechanism for spinning a supply of anaerobic material in a controlled manner onto the wall of a bore or cavity by rotatably driving a material reservoir and spin cup so that the material will be forced onto the inwardly inclined wall of the reservoir and then through small opening therein and onto outwardly flared walls of the spin cup and be forced outwardly therefrom and applied in a circular manner to the walls of the bore.

DETAILED DESCRIPTION OF THE DRAWINGS

Figure 1:
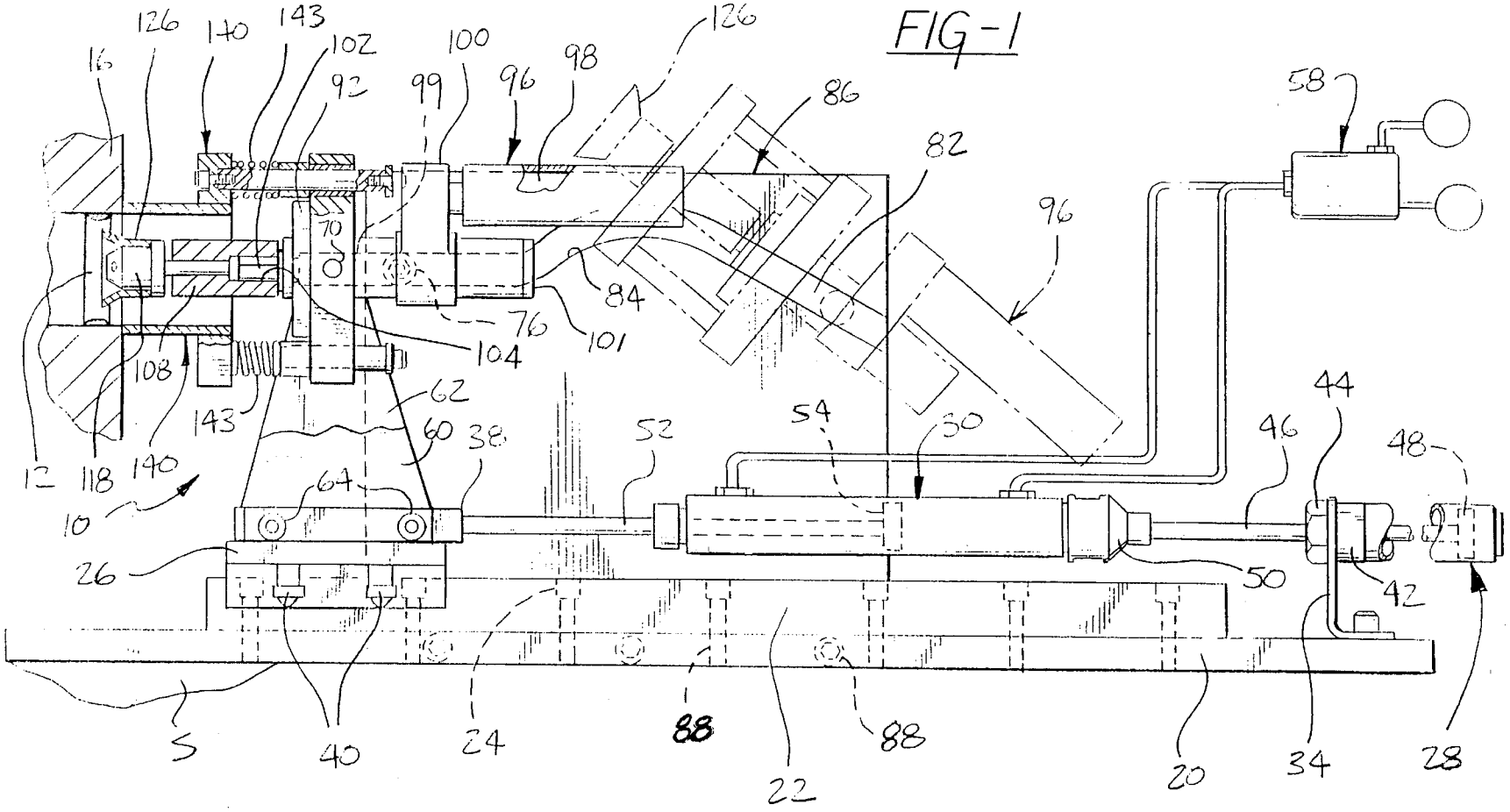
FIG. 1 is a diagrammatic side elevational of a machine for applying a viscous locking and sealing material into a bore in a work piece.
Figure 2:
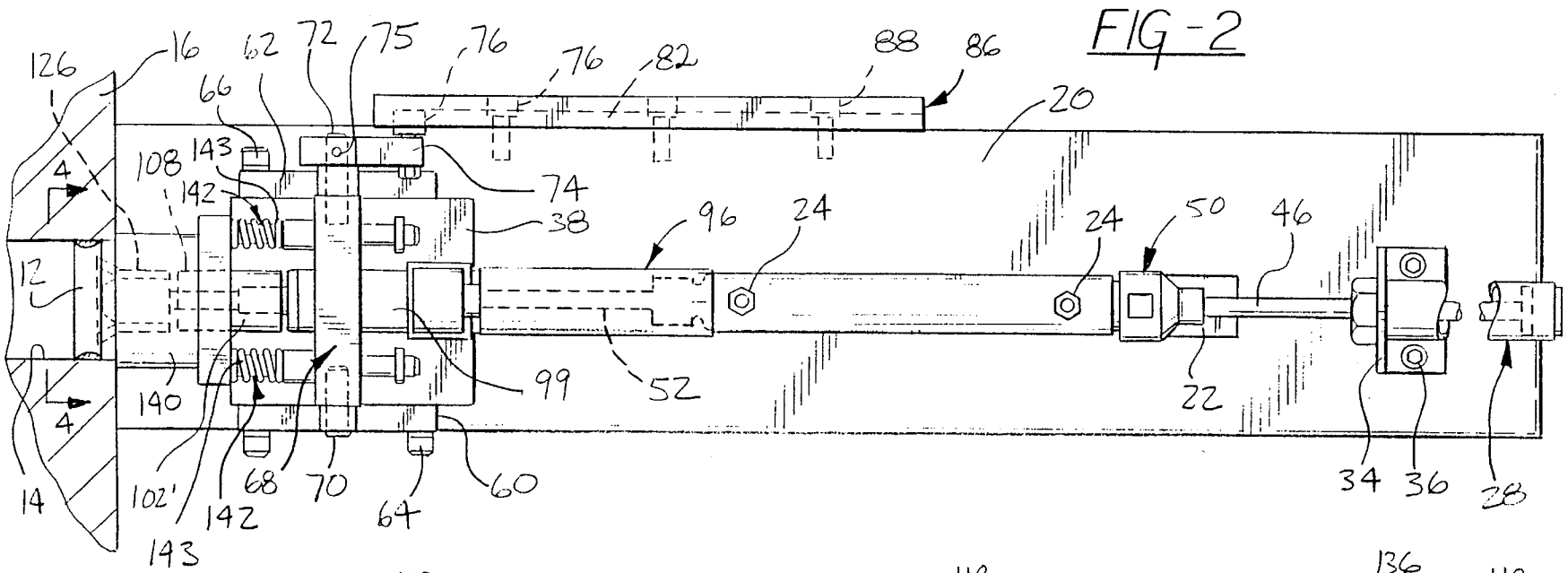
FIG. 2 is a top view of the machine of FIG. 1 taken generally along sight lines 2—2 of FIG. 1.

Turning now in greater detail to the drawing there is shown in FIGS. 1 and 2, a machine 10 for applying an annular bead of an anaerobic locking and sealing material 12 into an annular freeze plug bore 14 formed in an internal combustion engine case 16. This material is applied to seal and permanently retain a mating freeze plug (not shown) subsequently installed therein.

The machine of this preferred embodiment has a rectilinear base plate 20, mounted on a floor or other support S, which has an upstanding track 22 secured along the longitudinal axis thereof by threaded fasteners 24. A carriage 26 is slidably supported on the track for axial back and forth movement therealong by operation of a pair of pneumatic cylinders 28 and 30 operatively connected in tandem between an upstanding rear support bracket 34 secured by threaded fasteners 36 to the base plate 20 and a connector plate 38 secured to the top of the carriage 26 by threaded fasteners 40.

More particularly, the rearmost pneumatic cylinder 28 is mounted in a retainer 42 supported at the upper end of the bracket 34 and is secured thereto by a hex nut 44. The rod 46 of the piston 48 of the pneumatic cylinder 28 extends longitudinally into an end connector 50 that is secured to the end of pneumatic cylinder 30. The rod 52 of piston 54 of pneumatic cylinder 30 connects at its outer end to the connector plate 38. By contraction and expansion action of the pneumatic cylinders 28 and 30 through controls diagrammatically shown at 58, the carriage 26 and connector plate 38 and components supported thereon are linearly moved on the track 22 as will be further explained hereinafter.

As best illustrated in FIGS. 1 and 2, the connector plate has a pair of upstanding support arms 60, 62 secured at their lower ends to opposite sides of the connector plate 38 by threaded fasteners 64, 66. These arms extend upwardly and have a tiltable carrier 68 mounted therebetween by pivot pins 70, 72 journaled in the upper ends of the arms. The pivot pin 72 extends axially and outwardly of the arm 62 and connects to a longitudinally extending cam follow arm 74 by a set screw or pin 75.

The free end of the cam follower arm supports a cam follower 76 which is mounted on the free end of a transverse shaft 80 secured to the follower arm. The cam follower 76 rides in a cam track 82 having a curved camming section 84 routed in a rectilinear camming plate 86 side mounted and secured at its lower edge to an outer edge of the base 20 by threaded fasteners 88. Since the cam follower arm is secured to the pivot pin 72, the carrier 68 secured thereto will be tilted when the camming section or "hump" in the cam track is traversed by the cam follower.

Secured to the tiltable carrier 68 by an attachment bracket 92 and threaded fasteners 94 is a motor unit 96. This unit comprises an air motor 98 or other suitable drive motor having an output connected by transverse power transmission mechanism such as spur gears, friction rollers or drive belt to a rotatable output or shafting rotatably mounted in cylindrical casing 100 and terminating at its forward end in a drive member 102 polygonal in cross section that forms the output of the pneumatic motor unit 96.

Figure 5B:
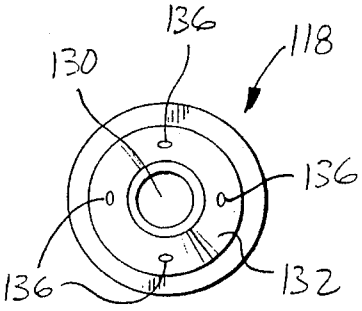
FIG. 5B is a front end view of the reservoir cup of FIG. 5*a*.
Figure 5A:
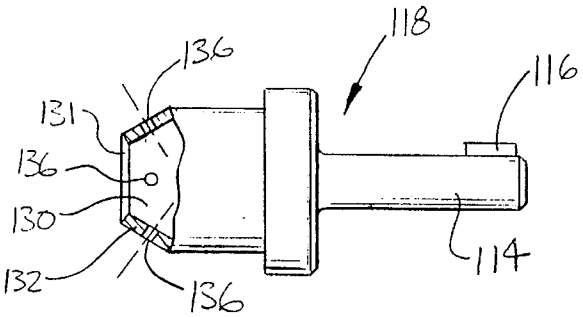
FIG. 5A is a side elevational view with part broken away of the reservoir cup of FIG. 5.
Figure 5:
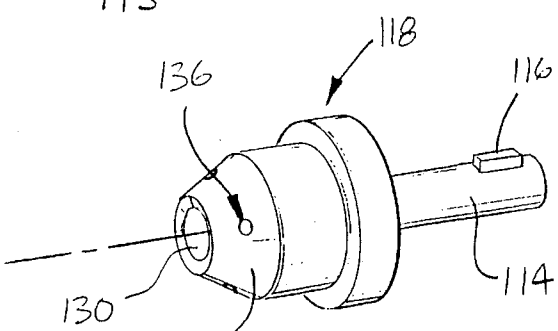
FIG. 5 is a pictorial view of the reservoir cup for the locking and sealing material of the machine of FIGS. 1, 2 and 3.
Figure 4:
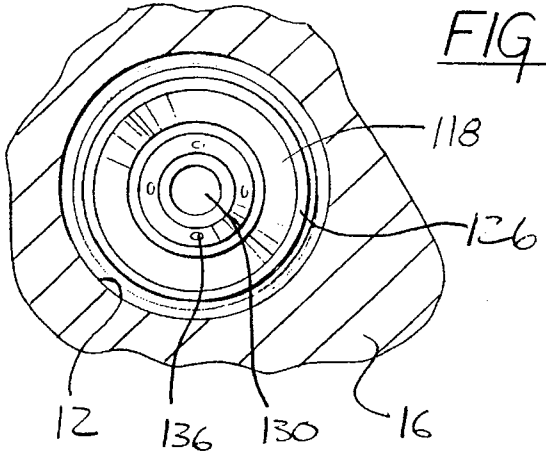
FIG. 4 is a cross-sectional view of a portion of the work piece with a sealant reservoir and spin cup assembly of the machine within the bore of the work taken generally along line 4—4 of FIG. 2.
Figure 6A:
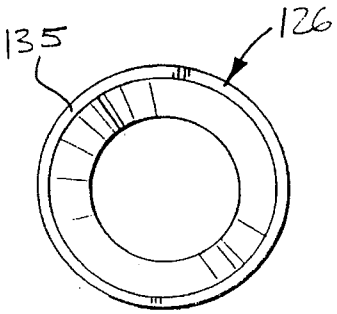
FIG. 6A is an end view of the spin cup of FIG. 6.
Figure 6:
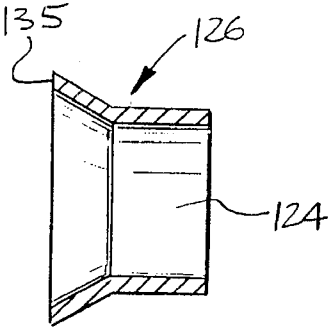
FIG. 6 is a cross sectional view of the spin cup of the machine of FIGS. 1, 2 and 3.
Figure 3:
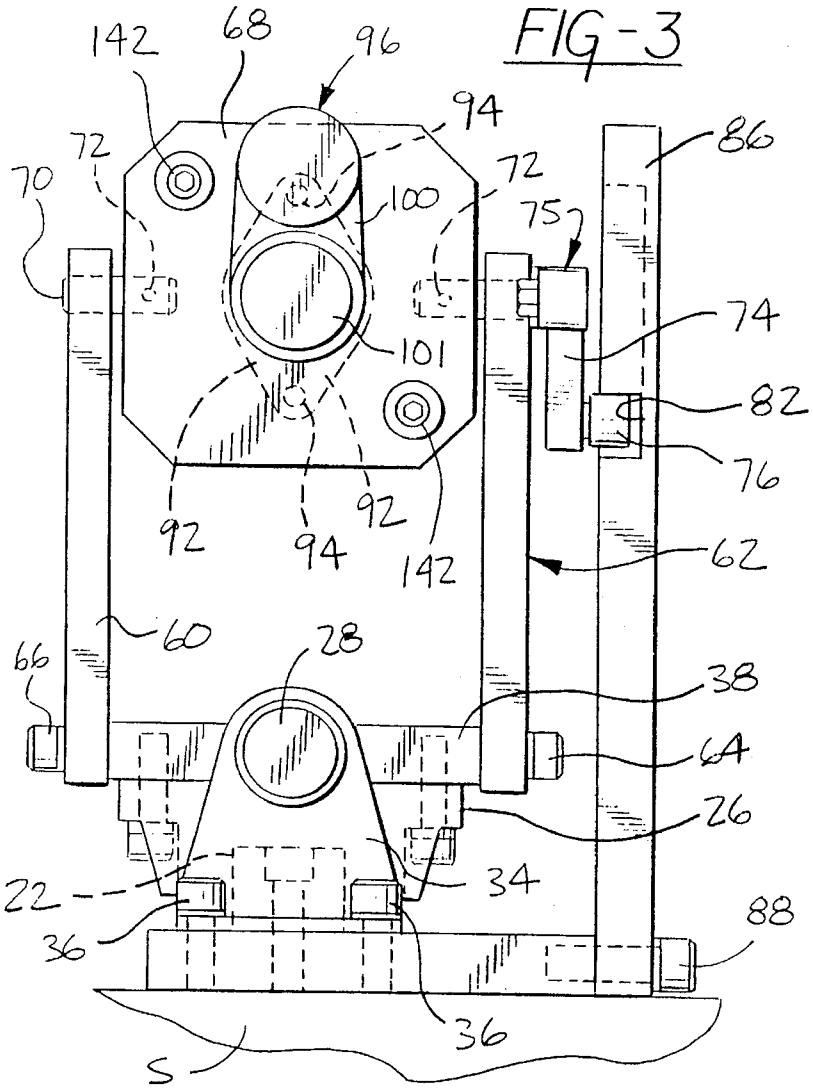
FIG. 3 is a cross-sectional view of the machine as seen along sight line 3—3 of FIG. 2.

The drive member 102 drivingly fits in a correspondingly shaped axial drive socket 104 formed in the center of a cylindrical coupling 108 which rotates with the drive member. Socket 110 formed with a key way 112 extends axially inwardly from the outboard end of the cylindrical coupling 108 to receive the cylindrical drive stem 114 and radial key 116 of a spin cup drive member 118. As best shown in FIGS. 5 and 5A and 5B, the spin cup drive member has a cylindrical head 120 formed with a reduced diameter shoulder 122 to receive the cylindrical end 124 of a spin cup 126. The spin cup 126 and the spin cup drive member 118 are operatively fitted to one another to provide a spin cup assembly 128.

In addition to the shoulder for fitting the spin cup 126 thereon, the spin cup drive member 118 has a central reservoir 130 having an opening axially formed in the outboard end thereof encompassed by a conical wall 132 that terminates in a small diameter axial end opening 134. As shown, the diameter of the wall progressively decreases from the body to the outer end thereof. The conical wall has one or more holes 136 here having a diameter of ⅙th inch in diameter, for example, are drilled or otherwise formed therein which extend into the reservoir 130 of the head 120 of the spin cup drive member 118.

A shroud of cowl unit 140 is mounted by a pair of forwardly extending compression spring units 142 preferably diagonally located from one another, as shown in FIG. 1. The helical springs 143 of these units hold the outer cylindrical shell of the cowl unit in an extended position to cover the spin cup and spin cup drive member assembly when moved into the bore 14 of workpiece 16.

When moved into the work position, the cowl unit retracts when the work encounters the cowl to compress the spring 143 of the spring unit so that the cylindrical shell of the cowl units seats around the bore 14 to confine any sealant and retainer material 12 that may escape from application in the bore. By confining the material 12, the application of the sealant and retainer material is closely controlled and confined to the walls defining the bore 14.

FIGS. 6, 6A, 7 and 8 show the spin cup 126 in greater detail and it will be seen that the spin cup has a cylindrical attachment body which fits onto the shoulder of the spin cup drive 118. From the upper extent of the cylindrical attachment portion, the wall 146 of the spin cup flares outwardly in a cone-like fashion to a terminal annular apply end 135 which is sized to fit within the bore 14 in the body of the workpiece 16.

Figure 8:
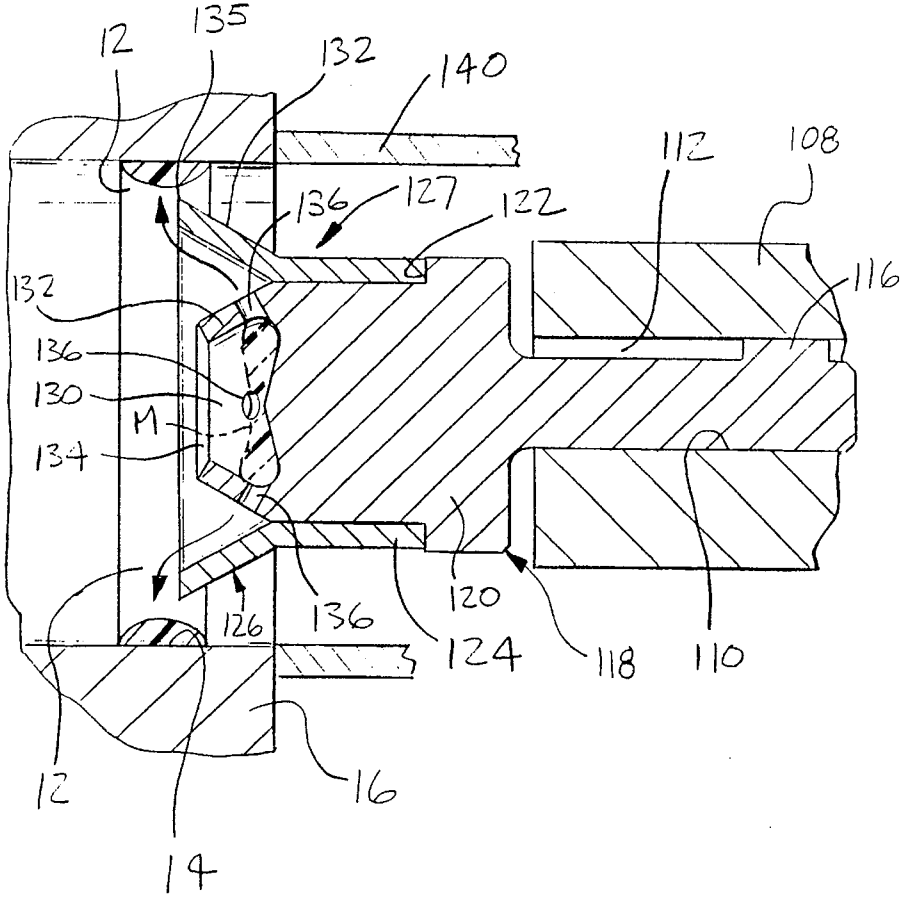
FIG. 8 is a view of the reservoir and spin cup assembly in an position to apply the locking and sealant material onto the walls defining the bore of FIGS. 1–3 before installation of a bore plug therein.

In viewing FIG. 8, it will be seen that the anaerobic material M in the reservoir 130 will be forced outwardly through the openings 136 in the wall of the reservoir which confines the anaerobic material therein. As centrifugal forces increase, the anaerobic material will be forced through the side openings 136 in the walls of the reservoir and onto the walls of the spin cup. The material is then forced to climb outwardly flaring wall of the spin cup which spins a ribbon of anaerobic material onto the walls 14 defining the bore in the engine block 16.

After the anaerobic material is layered in an annular ribbon on the bore wall, the spin cup and spin cup drive is removed from the bore and a freeze plug, or other closure member, is axially inserted into the bore. The anaerobic material being trapped between the outer periphery of the freeze plug and the wall 14 defining the bore will cure and freeze permanently and firmly retain and seal the freeze plug in the engine block.

In preferred operation for loading the anaerobic material, the cylinder 30 will be actuated so that the piston 54 will retract to move the carriage on track 22 and thus retract the spin cup and the spin cup drive from the bore. On this retraction, the springs expand to move the cowling 140 over the spin cup so that any anaerobic seal and retaining material will be caught therein and not dripped or deposited on the machine or the floor.

Figure 7:
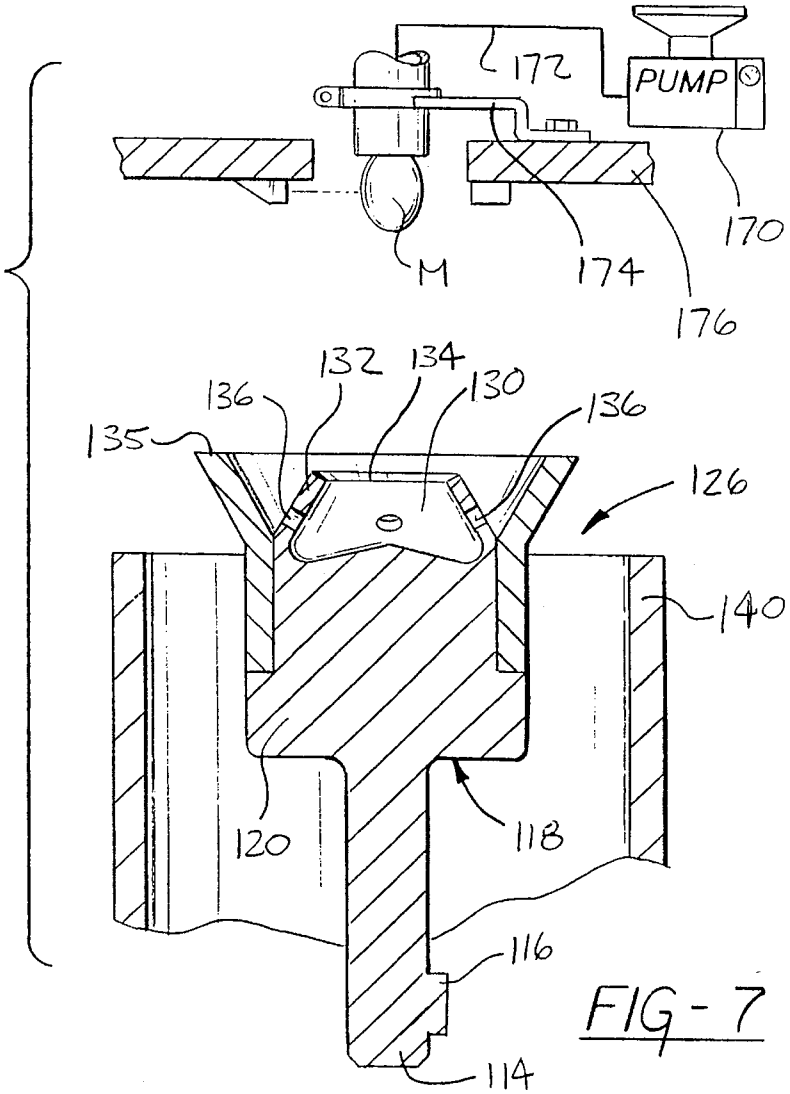
FIG.7 is a diagrammatic cross sectional view of the reservoir cup and spin cup assembly and positioned to receive a supply of locking and sealing material from a supply above the machine.

As the spin cup and spin cup drive is being retracted, the tiltable carrier plate 68 will be moved rearwardly and the cam 76 riding in the cam track 82 will reach the camming area of the track in which the spin cup is turned downwardly and then to an upward loading position shown in FIGS. 1 and 7.

In FIG. 1, the machine 10 can be mounted on a support S which is angled upwardly at 45 degrees, for example, so that the spin cup 126 will be vertical as diagrammatically shown in FIG. 7. At this position, a pump 170 is activated to pump a supply of the anaerobic material M through a supply tube 172 retained in position by a bracket 174 and support plate 176 immediately above the upwardly extending reservoir. The pump pumps a predetermined amount of anaerobic material M which falls into the reservoir 130 of the spin cup drive member 118. A photocell or other instrumentation signals the depositing of the anaerobic material M when the circuit is broken by the anaerobic material through the light of the photocell. The pump then is cut off so that no further material is pumped. The cylinder 30 is again actuated and the piston moves the cylinder forward until it reaches its forward extent and the spin cup and spin cup drive assembly is within the bore. As the bore is reached, the cowling 140 will strike the periphery of the bore to cause its retraction as shown in FIG. 1 and the spin cup drive member and the spin cup are accordingly properly positioned in the bore for application of the anaerobic material to the wall of the bore as previously described.

In view of the fact that the viscosity of the anaerobic material is sufficiently high, there will be no leakage of the material through the small diameter openings 136 in the walls defining the reservoir and no leakage therefrom. As previously described, the rotation of the spin cup by the energization of the motor 98 will affect the deposit of the anaerobic material on the wall of the bore. In the event that the mechanism needs to be fully retracted, both cylinders 30 and 28 are energized to move the spin cup, the tilt carrier and the drive motors by moving the carriage to a further extent on the track 82 so that the mechanism can be serviced as required.

While a preferred embodiment of the invention has been shown and described, other embodiments will now become apparent to those skilled in the art. Accordingly, this invention is not to be limited to that which is shown and described but by the following claims.

What is claimed is:

1. A spin unit for receiving a quantity of viscous material and for spinning a material distribution member to apply a layer of viscous material onto the wall defining an opening in a workpiece so that a device having an outer periphery sized to fit into said opening can be installed into the opening with the viscous material disposed between the outer periphery thereof and the wall defining said opening, said spin unit comprising a spin cup drive member rotatable about a longitudinal axis, said spin cup drive member having a head portion with an outer end, said head portion of said spin cup drive member having a centralized reservoir in the outer end thereof defined by a confining wall which extends axially from the head portion, said confining wall having a restricted outer opening to define an axial entrance to said reservoir so that viscous material can be supplied into said reservoir, said confining wall having at least one material discharge opening therein sized to normally block the flow of said viscous material therethrough under static conditions and sized to allow the viscous material to flow therethrough in response to centrifugal forces experienced by said material when said spin unit is rotatably driven at selected angular velocities, said confining wall being a truncated conical wall and the truncated end of said conical wall defines said axial entrance leading into said reservoir, said conical wall being configured so as to retain said viscous material in said reservoir until said reservoir and viscous material therein are rotated with sufficient angular velocity and the centrifugal force on said viscous material forces the viscous material to flow through said material discharge opening.

2. A spin unit for receiving a quantity of viscous material and for spinning a material distribution member to apply a layer of viscous material onto the wall defining an opening in a workpiece so that a device having an outer periphery sized to fit into said opening can be installed into the opening with the viscous material disposed between the outer periphery thereof and the wall defining said opening, said spin unit comprising a spin cup drive member rotatable about a longitudinal axis and having a head portion, said spin cup drive member having a centralized reservoir in the outer end thereof defined by a confining wall which extends axially and outwardly from the head portion, said extending wall defining a restricted outer opening to provide an axial entrance so that said viscous material can be supplied into said reservoir, said extending wall having at least one material discharge opening therein sized to normally block the flow of said viscous material therethrough under static conditions and sized to allow the viscous material to flow therethrough in response to centrifugal forces experienced by said material when said spin unit is rotatably driven at selected angular velocities, the material distribution member being a spin cup mounted on said spin cup drive member, said spin cup having an outwardly flaring wall with a terminal edge disposed adjacent to the wall defining said opening in said workpiece, said viscous material exiting the reservoir only through the material discharge opening in said wall of said head portion in response to centrifugal forces impressed thereon so that the material flows from said material discharge opening onto the outwardly flaring wall of the spin cup and past the outer end thereof for application of a circular layer of said viscous material onto the wall defining said opening in the workpiece, said wall of said spin cup defining a delivery cone to spin a continuous circular layer of said material onto the wall defining said opening in said workpiece and said spin cup having a centralized attachment section to fit on the head portion of said spin cup drive member, a rotatable power drive for said spin unit and a cowl unit surrounding said spin cup to catch and confine viscous material inadvertently spilled therefrom.

3. The combination of claim 2, and further comprising a support yieldably mounting said cowl unit around said spin cup so that said cowl unit will contact and be retained by said workpiece allowing said spin unit and said cup to extend beyond said cowl unit and enter said opening in the workpiece and past the end of said cowl unit.

4. The combination of claim 3 and further comprising an actuator mechanism to retract said spin unit and to tilt said spin unit into an upward orientation so that said viscous material can be inserted into said reservoir of said spin unit.

5. The combination of claim 4, wherein said material is an anaerobic locking material, a source of said anaerobic material having a delivery outlet aligned with said reservoir when said reservoir is in a retracted position and an optical mechanism to signal the delivery of a quantity of said anaerobic material into the reservoir.

6. The combination of claim 5 and further comprising a carrier for said spin unit, a linearly movable carriage with upstanding support arms, pivot means tiltably mounting said carrier to said support arms, a cam follower attached to said tiltable carrier, a fixed cam track receiving said cam follower associated with said tiltable carrier and said spin unit, an actuating mechanism for moving said carriage with said carrier and said spin unit between fully retracted, intermediate load and viscous material apply positions.

7. An apparatus for receiving a quantity of viscous material and for rotation together and applying a layer of such material onto a workpiece, said apparatus comprising a rotary drive having a head portion, said head portion having an outwardly extending and curved wall that connects to define a reservoir with an open outer end for receiving and storing said viscous material therein, a spin cup for receiving said material from said reservoir and for applying said material to a surface, said spin cup having an attachment portion secured to said head portion for rotation therewith and having an outwardly flaring and curved wall extending from said attachment portion and disposed radially and outwardly from said wall of said head portion.

8. The apparatus of claim 7, wherein said curved wall of said rotary drive converges inward to the open outer end thereof and wherein said outwardly flaring curved wall of said spin cup surrounds said wall of said rotary drive and extends axially beyond the open outer end thereof.

9. A spin cup drive member for receiving a quantity of viscous material and for spinning a viscous material distribution member to apply a layer of such material onto a wall defining an opening in a workpiece so that a device having an outer periphery sized to fit into said opening can be installed into the opening with the layer of viscous material disposed between the outer periphery thereof and the wall defining said opening, said spin cup drive member comprising a head portion with an outer end, said head portion of said spin cup drive member further having a centralized reservoir formed therein which opens at said outer end for holding said viscous material, said reservoir being defined by an inner bottom surface in said head portion and a confining side wall which surrounds said inner bottom surface and which extends outwardly therefrom, said confining side wall having a curved outer end to provide a restricted outer opening and an axial entrance leading directly into said reservoir so that said viscous material can be supplied into and retained in said reservoir, said confining side wall having at least one material discharge opening extending therethrough spaced from said outer opening that is sized to block the flow of said viscous material therethrough under static conditions and to allow said viscous material therein to flow therethrough for said reservoir in response to centrifugal forces experienced by said material when said spin cup drive member is rotatably driven at selected angular velocities.

10. A spin cup drive unit for receiving a quantity of viscous material and for spinning a viscous material distribution member to apply a layer of such material onto the wall defining an opening in a workpiece so that a device having an outer periphery sized to fit into said opening can be installed into the opening with the layer of viscous material disposed between the outer periphery thereof and the wall defining said opening, said spin cup drive unit comprising a spin cup drive member rotatable about a longitudinal axis, said spin cup drive member having a head portion with an outer end, said head portion of said spin cup drive member having a centralized reservoir formed therein and defined by an inner bottom surface and a confining side wall which surrounds said inner bottom surface and which extends outwardly therefrom, said confining side wall having a curved outer end to provide a restricted outer opening and an axial entrance to said reservoir so that said viscous material can be supplied to and retained in said reservoir, said confining side wall having at least one material discharge opening therethrough spaced from said outer opening that is sized to normally block the flow of said material therethrough under static conditions and sized to allow the material therein to flow therethrough in response to centrifugal forces experienced by said material when said head portion of said spin drive member is rotatably driven at selected angular velocities, said confining side wall being a truncated conical wall whose diameter progressively decreases from said inner surface to said outer opening, said conical wall being configured so as to retain said viscous material in said reservoir until said reservoir is rotated with sufficient angular velocity and the centrifugal force on said material forces the material to flow through said material discharge opening.

11. The spin cup drive unit of claim 10, wherein said spin cup is operatively mounted on said spin cup drive member to provide a spin cup assembly, said spin cup having an outwardly flaring wall with a terminal edge disposed adjacent to the walls defining the opening in the workpiece, said viscous material exiting the reservoir only through the material discharge opening in the side of the confining walls thereof in response to centrifugal forces impressed thereon so that the material flows from said material discharge opening onto the outwardly flaring wall of the spin cup and past the outer end thereof for application of a circular layer of said viscous material onto the wall defining said opening in said workpiece.

12. The spin cup drive unit of claim 10, wherein said spin cup has an outwardly flaring delivery cone to spin a continuous circular layer of said material onto the wall defining said opening and said spin cup further has a centralized attachment section to fit on the head portion of said spin cup drive member.

13. The spin cup drive unit of claim 12, and further comprising a rotatable power drive for said spin unit and a cowl unit surrounding said spin cup to catch viscous material spilled therefrom.

14. The spin cup drive unit of claim 13, and further comprising a support yieldably mounting said cowl unit around said spin cup so that said cowl unit will contact and be retained by said workpiece allowing said spin unit and said spin cup to extend beyond said cowl unit and enter said opening and past the end of said cowl unit.

15. A combined rotary drive for receiving a quantity of viscous material and a material distribution cup member operatively mounted to said rotary drive for rotation thereby to apply a layer of the viscous material onto a workpiece, said rotary drive comprising a head portion with an outer end, said head portion of said rotary drive having a centralized reservoir formed therein defined by an inner surface in said head portion and a confining wall which surrounds said inner surface and which extends outwardly therefrom, said confining wall having a curved outer end to provide a restricted outer opening and an axial entrance into said reservoir so that said viscous material can be initially supplied thereto, said reservoir having a material discharge to allow the viscous material to exit therefrom in response to centrifugal forces experienced by said material when said drive is rotatably driven at selected angular velocities, said material distribution cup having a curved outer wall surrounding said confining wall of said reservoir of said rotary drive to receive the material exiting therefrom and to subsequently apply said material onto said workpiece.

16. The combination of claim 15, wherein said material distribution cup has an attachment section drivingly fitted on said head portion of said rotary drive and further has a conical delivery section to define said curved outer wall surrounding said confining wall of said reservoir.

* * * * *